US008051611B2

(12) United States Patent
Serino et al.

(10) Patent No.: US 8,051,611 B2
(45) Date of Patent: Nov. 8, 2011

(54) EXTERIOR INSULATION AND FINISH SYSTEM AND METHOD AND TOOL FOR INSTALLING SAME

(75) Inventors: Roland Serino, East Greenwich, RI (US); Brian Walter Hickey, Ashaway, RI (US); Chander Patil, Burlington, MA (US)

(73) Assignee: Dryvit Systems, Inc., West Warwick, RI (US)

( * ) Notice: Subject to any disclaimer, the term of this patent is extended or adjusted under 35 U.S.C. 154(b) by 1485 days.

(21) Appl. No.: 11/166,563

(22) Filed: Jun. 24, 2005

(65) Prior Publication Data

US 2007/0011986 A1 Jan. 18, 2007

(51) Int. Cl.
*E02D 19/00* (2006.01)

(52) U.S. Cl. ..... 52/169.14; 52/169.5; 52/302.1; 52/309.9; 52/506.01; 52/408; 52/413; 52/783.19; 52/741.4

(58) Field of Classification Search ..... 52/408, 52/413, 169.5, 169.14, 302.1, 309.8, 309.9, 52/446, 450, 453, 506.01, 515, 516, 783.11
See application file for complete search history.

(56) References Cited

U.S. PATENT DOCUMENTS

| | | | | |
|---|---|---|---|---|
| 2,395,186 | A * | 2/1946 | Jones | 15/235.6 |
| 3,119,138 | A * | 1/1964 | Davis | 15/245.1 |
| 3,274,048 | A | 9/1966 | Armour et al. | |
| 4,254,980 | A | 3/1981 | Anderson | |
| 4,349,398 | A | 9/1982 | Kearns et al. | |
| 4,647,496 | A | 3/1987 | Lehnert et al. | |
| 4,730,953 | A * | 3/1988 | Tarko | 405/45 |
| 4,766,635 | A | 8/1988 | DeVitis | |
| 4,882,888 | A * | 11/1989 | Moore | 52/309.9 |
| 5,363,621 | A | 11/1994 | Kroll et al. | |
| 5,392,578 | A | 2/1995 | Kroll et al. | |
| 5,410,852 | A | 5/1995 | Edgar et al. | |
| 5,564,243 | A | 10/1996 | Kroll et al. | |

(Continued)

FOREIGN PATENT DOCUMENTS

DE 34 45 187 A1 6/1985

(Continued)

OTHER PUBLICATIONS

PCT Notification of Transmittal of the International Search Report and the Written Opinion of the International Searching Authority, or the Declaration; Form PCT/ISA/220; 2 pages.

(Continued)

*Primary Examiner* — Jessica Laux
(74) *Attorney, Agent, or Firm* — Fay Sharpe LLP

(57) ABSTRACT

An exterior insulation and finish system (EIFS) is provided for use with associated insulation and substrate layers of a building. The system includes primary and secondary water resistant barriers on first and second surfaces of the associated insulation layer. The secondary water resistant barrier includes a single adhesive and sealing layer defining at least one channel and adhesively securing the second surface of the associated insulation layer to the associated substrate layer. The system is usable with a plurality of associated insulation layers disposed in abutment, the single adhesive and sealing layer defining at least one channel extending from the first insulation panel to the second insulation panel and being adapted to conduct fluid therethrough. Further, a hand tool for working the adhesive and sealing layer is provided. The hand tool includes a handle connected with a flat inflexible rectangular plate, at least one of the longer edges thereof being upwardly curved and including a plurality of spaced apart teeth.

19 Claims, 6 Drawing Sheets

U.S. PATENT DOCUMENTS

| | | | | |
|---|---|---|---|---|
| 5,979,131 | A | 11/1999 | Remmele et al. | |
| 6,410,118 | B1 * | 6/2002 | Reicherts et al. | 428/141 |
| 6,931,809 | B1 * | 8/2005 | Brown et al. | 52/409 |
| 2005/0053723 | A1 | 3/2005 | Brzoska | |

FOREIGN PATENT DOCUMENTS

| | | | |
|---|---|---|---|
| EP | 0 086 681 | | 8/1983 |
| EP | 0 926 303 | A2 | 6/1999 |

OTHER PUBLICATIONS

PCT International Search Report; Form PCT/ISA/210; 5 pages.
PCT Written Opinion of the International Searching Authority; Form PCT/ISA/237; 9 pages.
Form PCT/ISA/206—Invitation to Pay Additional Fees, with Annex to Form PCT/ISA/206—Communication Relating to the Results of the Partial International Search.

* cited by examiner

EXTERIOR INSULATION AND FINISH SYSTEM AND METHOD AND TOOL FOR INSTALLING SAME

The present exemplary embodiments relate to the construction arts. They find particular application in conjunction with exterior insulation and finish systems (EIFS), and to a hand tool for use therewith, and will be described with particular reference thereto. However, it is to be appreciated that the present exemplary embodiments are also amenable to other like applications.

BACKGROUND

Basic drainage type exterior insulation and finish systems (EIFS) and construction techniques therefor are well known in the art. In the general case, as shown in FIG. 1, exterior insulation and finish systems are applied over a first layer of a sheathing substrate which is normally applied to the exterior of a building under construction. The sheathing 12 may be a gypsum sheathing, exposure oriented strand board (OSB), exterior or exposure 1 grade plywood, or cementitious materials. EIFS may also be applied over other masonry substrates such as cement masonry unit blocks or bricks.

Using a paint roller, an adhesive and seal layer 14 is applied onto the first layer 12 of sheathing. Preferably, the adhesive is water based and fast drying and, once dried, is flexible so as to bridge normal movement in the first layer 12. The adhesive and seal layer 14 forms a weather proof seal for the first layer 12.

After drying, an insulation board 16 is adhered to the first layer 12 by the adhesive and seal layer 14. In the prior art system illustrated, the insulation board 16 is special in that it includes a plurality of grooves 18 provided for purposes of conducting fluid which may accumulate between the insulation board 16 and the first layer 12.

An initial base coat 20 is then applied to the surface of the insulation board 16 opposite the surface which is secured to the substrate layer 12 by the adhesive and seal layer 14. The initial base coat may be applied over the insulation board with spray equipment or a trowel to a uniform thickness. Next, a mesh layer 22 is immediately embedded in the wet base coat 20 by troweling or using other techniques. An additional base coat 24 may be applied over the surface of the mesh material 22 as needed and, lastly, a finish coat 26 is applied to the base coat 24 by spraying or troweling, depending on the specific finish desired.

Although drainage type EIFS of the type described above have been very successful, some limitations in application have been encountered. More particularly, the insulation board 16 must either be provided with a plurality of grooves 18, or have some other means in order for the system to properly conduct fluid. Also, during installation, the grooved insulation board 16 must be oriented in the proper direction with the grooves 18 oriented vertically and facing the sheathing substrate 12 of the structure. Still further, although the system described above functions to conduct fluid, care is required in order to position ends of insulation boards 16 so that the grooves 18 formed are in alignment to provide a continuous fluid evacuation conduit. Also, a delay is necessary to allow the seal coating to fully cure prior to adhering the insulation board. Such a delay is usually a minimum of 24 hours and can result in additional costs to the contractor both in delays as well as costs of providing weather protection for the additional time cause by the delay.

Lastly, if construction workers are impatient or for other reasons apply the insulation board 16 onto the sheathing 12 before the adhesive layer 14 is adequately cured, the adhesive layer material could migrate into the grooves 18 formed in the board 16 and thereby obstruct the fluid path.

Accordingly, there is a need for an improved method and tool for installing exterior insulation and finish systems which overcomes the above limitations and others and provides an inexpensive and convenient solution thereto.

BRIEF DESCRIPTION

In accordance with one aspect of a first present exemplary embodiment, a drainage type exterior insulation and finish system for a building is provided. The system is applied over a sheathing substrate and includes an insulation board, a single adhesive and sealing layer, a base coat, a mesh layer, and a finish layer. The sheathing substrate is adapted for attachment to a frame of an associated building or other structure. The single adhesive and sealing layer adhesively secures the insulation board to the sheathing substrate. The layer is disposed between the sheathing substrate and the insulation board and defines at least one via adapted to conduct fluid such as water for example. The base coat is applied onto the insulation board, followed by a mesh layer, and then a finish layer. In its preferred form, the sheathing substrate has a flat front face and the insulation board has opposite flat front and rear faces. The flat rear face of the insulation board is oriented toward the flat front face of the sheathing substrate with the at least one via being defined by the single adhesive and sealing layer and disposed between the sheathing substrate and the insulation board. In another form, a plurality of viae are defined in the single adhesive and sealing layer to conduct fluid therethrough.

In accordance with an aspect of a second exemplary embodiment, an exterior insulation and finish system for use with associated insulation and substrate layers of a building is provided: The exterior insulation and finish system includes primary and secondary water resistive barriers. The primary water resistive barrier is disposed on a first surface of the associated insulation layer. The secondary water resistive barrier is disposed on a second surface of the associated insulation layer. The secondary water resistive barrier includes a single adhesive and sealing layer defining at least one channel and adhesively securing the second surface of the associated insulation layer to the associated substrate layer. In one form, the single adhesive and sealing layer defines a plurality of channels, each being adapted to conduct fluid therethrough. The channels are formed between the second surface of the insulation layer and a surface of a groove provided in the single adhesive and sealing layer.

In accordance with an aspect of another exemplary embodiment, an exterior insulation and finish system for a building is provided. The system is applied over a sheathing substrate for attachment to a frame of an associated building, and includes first and second insulation boards, a single adhesive and sealing layer securing the insulation boards to the sheathing substrate and defining at least one via adapted to conduct fluid, a base coat, a mesh layer, and a finish layer. The at least one via defined by the single adhesive and sealing layer extends from a first location disposed between the sheathing substrate and the first insulation board to a second location disposed between the sheathing substrate and the second insulation board. In that way, at least one via is provided between the insulation boards and the sheathing substrate and extending between the first and second insulation boards. In another form, the at least one via extends uninterrupted from the first location to the second location. Still further, a plurality of viae are provided. They are defined by the single adhesive and sealing layer and extend uninterrupted from the first location to the second location.

In accordance with a still further aspect of another exemplary embodiment, an exterior insulation and finish system is provided for use with associated first and second insulation panels applied over an associated substrate layer of a building. The system includes primary and secondary water resistive barriers. The primary water resistive barrier is disposed on a first surface of the associated first and second insulation panels. The secondary water resistive barrier is disposed on a second surface of the associate first and second insulation panels. The secondary water resistive barrier includes a single adhesive and sealing layer defining at least one channel and adhesively securing the second surface of the associated first and second insulation panels to the associated substrate layer with at least one edge of each of the first and second insulation panels being in substantial abutment. The at least one channel extends from the first insulation panel to the second insulation panel and is adapted to conduct fluid therethrough.

Still further, in accordance with yet another aspect of an exemplary embodiment, a hand tool is provided for working an adhesive and sealing layer in an exterior insulation and finish system. The hand tool includes a flat inflexible rectangular plate connected with a handle. At least a first one of the longer edges of the inflexible rectangular plate is upwardly curved and includes a plurality of spaced apart teeth. In use, the plurality of teeth form grooves defining the viae and channels described above for conducting fluid between the sheathing substrate and the insulation board. Preferably, the plurality of spaced apart teeth are defined by a plurality of notches formed in the longer edge of the rectangular plate of the hand tool. In their preferred form, the plurality of notches include an elongate first section having a substantially uniform predefined width terminating at a rounded bight having a diameter substantially conforming to the uniform predefined width of the first section of the notches.

BRIEF DESCRIPTION OF THE DRAWINGS

The invention may take form in certain components, structures, and steps, the preferred embodiments of which will be illustrated in the accompanying drawings.

DETAILED DESCRIPTION

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

Figure 1:
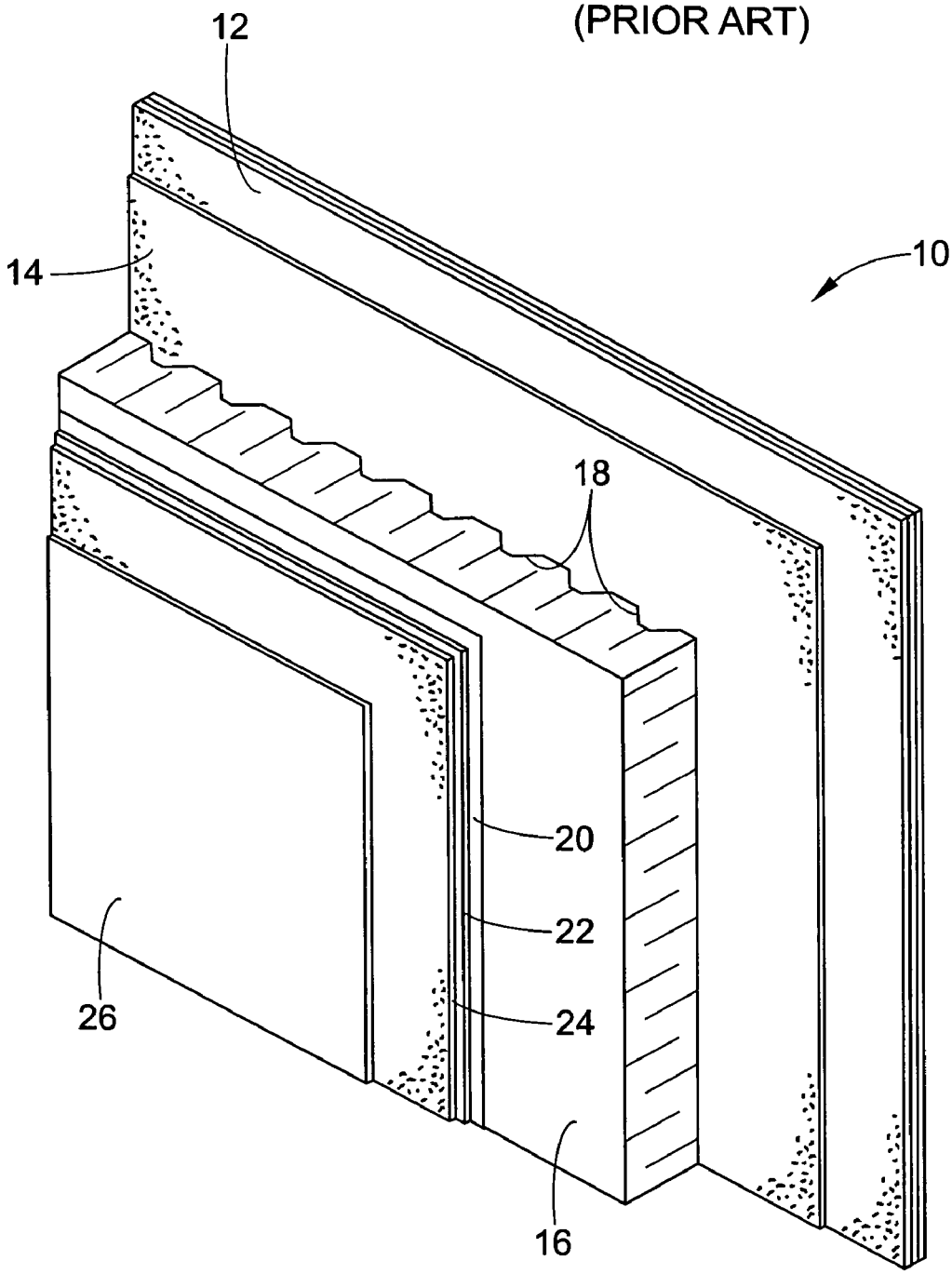
FIG. 1 (PRIOR ART)
FIG. 1 is a schematic representation of various layers forming a drainage type exterior insulation and finish system of the prior art.
Figure 2:
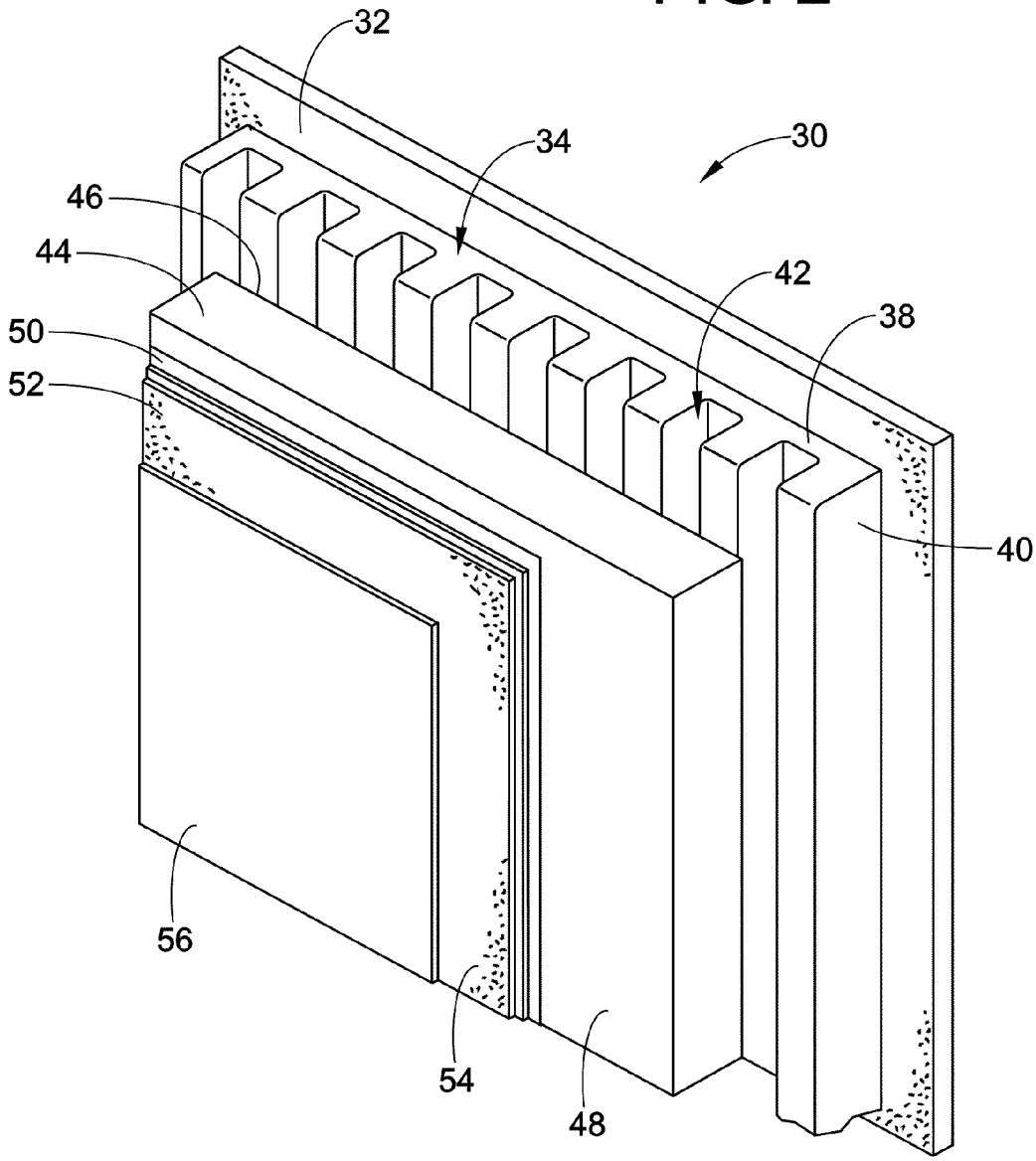
FIG. 2 is a schematic representation of the various layers forming the drainage type exterior insulation and finish system of the present application.

With reference to the drawings in general, and to FIG. 2 in particular, an exterior insulation and finish system (EIFS) embodying the teachings of the subject invention is generally designated at 30. With reference to its orientation in FIG. 2, the exterior insulation and finish system 30 is applied onto an associated sheathing substrate 32 which normally forms the exterior of a building under construction. The sheathing 32 may be gypsum sheathing, oriented strand board (OSB), exterior plywood, or other cementitious materials. In addition, the exterior insulation and finish system of the present application is equally applicable to other associated building substrates such as masonry, cement, cement masonry unit blocks, and the like.

The exterior insulation and finish system includes an adhesive and sealing layer 34 that is applied to the sheathing or other outer layer 32 of the associated building using a hand tool, the details and use of which will be described in greater detail below. Preferably, the adhesive is 100% water based and fast drying so as to decrease installation time. Preferably, the adhesive and sealing layer 34 is a polymer modified cementitious material available from Dryvit Systems, Inc. Once dried, the adhesive and sealing layer is preferably sufficiently flexible so as to permit normal movement and bridge across gaps in the sheathing layer 32. The adhesive and sealing layer 34 forms a water resistant seal for the sheathing layer 32. More particularly, as illustrated, the adhesive and sealing layer 34 is applied onto the outer layer 32 of the associated building (not shown) in a manner to result in a first portion 38 of material having a substantially uniform thickness to completely cover the substrate 32, and a second portion 40 having a non-uniform thickness to provide at least one via 42 for conducting fluids therethrough.

Immediately following the application of the adhesive and sealing layer 34 of the present EIFS, an insulation board 44 element of the EIFS having a flat front face 46 is adhered to the first sheathing layer 32 by the adhesive and seal layer 34. Simple hand pressure is applied over the entire insulation board surface to ensure a complete bond. It is to be appreciated that many types of insulation boards can be used equivalently including polisocyanurate board and others.

A further element of the EIFS includes an initial base coat 50. The initial base coat is applied to the flat outer surface 48 of the insulation board 44 which is secured to the substrate layer 32 by the adhesive and seal layer 34. The base coat 50 is applied over the insulation board using spray equipment, a trowel, or the like, to realize a uniform thickness of approximately 1/16 of an inch.

Another component of the EIFS includes a mesh layer 52. The mesh layer is embedded into the base coat 50 while it is wet by troweling from the center of the mesh toward the outer edges. In some cases, additional base coat material 54 may be applied over the surface of the mesh material 52 in order to ensure that the mesh is completely embedded into the base coat 50.

Lastly, a further component of the EIFS includes a finish coat 56 of an acrylic base or silicone enhanced textured wall coating applied onto the base coat 54. The finish coat 56 is applied by spraying, rolling, troweling, or the like, depending on the specific finish desired.

Figure 3:
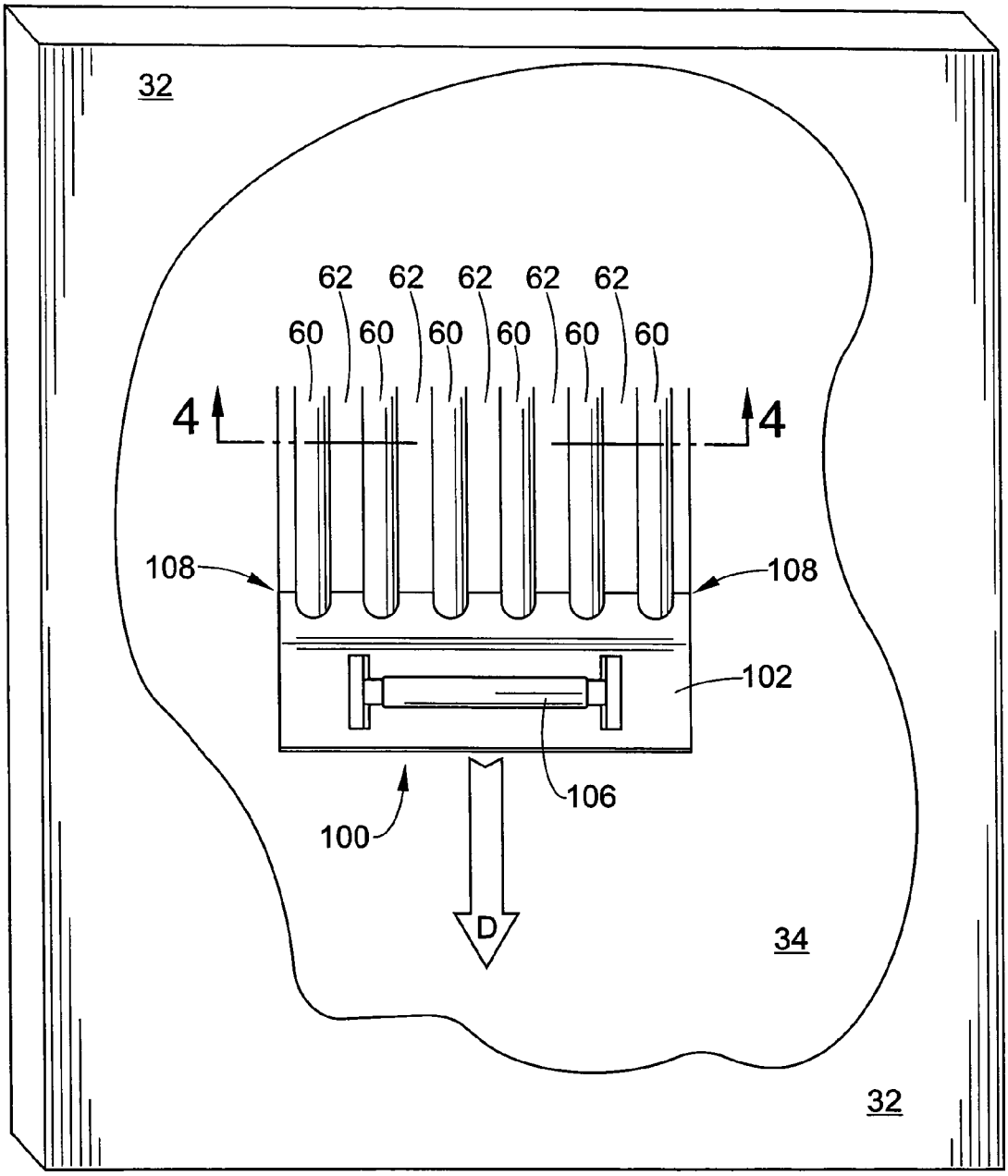
FIG. 3 illustrates application of an adhesive sealer onto a layer of sheathing substrate using a hand tool in accordance with the present application.

In FIG. 3, the adhesive and sealing layer 34 is shown being applied onto a substrate layer 32 which, in this example, is exterior plywood of an associated building (not shown). The adhesive and seal layer 34 is applied using a hand tool 100 preferably formed as a trowel 102 having a flat inflexible rectangular plate 104 and a handle 106 as illustrated. The hand tool 100 will be described in greater detail below.

With continued reference to FIG. 3, the hand tool 100 includes a toothed bent edge 108 adapted to form a series of ridges 60 and valleys 62 in the adhesive and sealing layer 34 applied onto the sheathing layer 32 as the hand tool 100 is dragged therealong in the direction marked D in the figure. As can be seen, the ridges 60 and valleys 62 are formed in an alternating pattern beneath the tool as the edge 108 moves through the moist adhesive and sealing layer 34.

Figure 4:
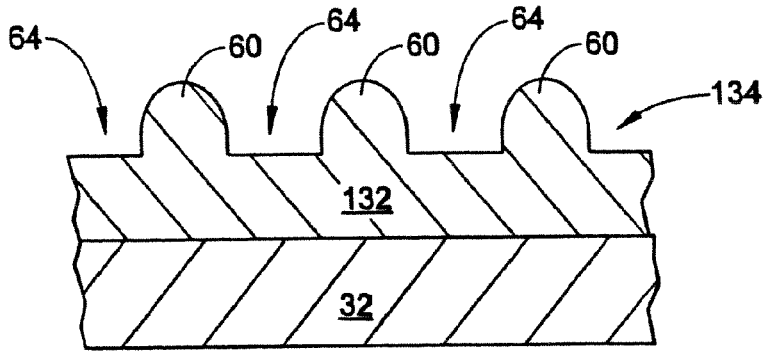
FIG. 4 is a cross-sectional illustration taken along line 4-4 of FIG. 3.
Figure 5:
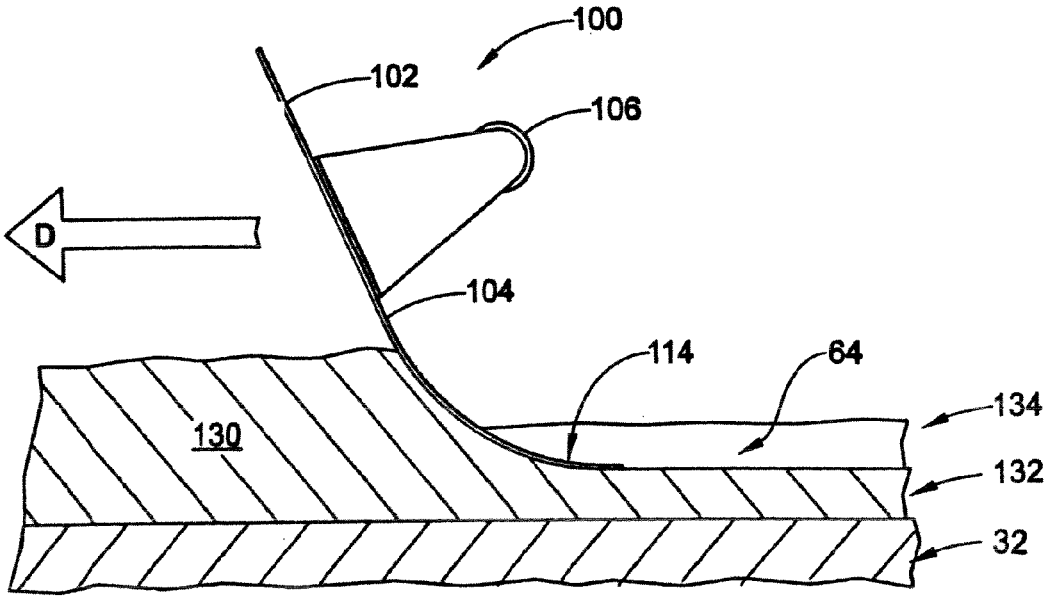
FIG. 5 is a cross-sectional illustration taken along line 5-5 of FIG. 3.
Figure 6:
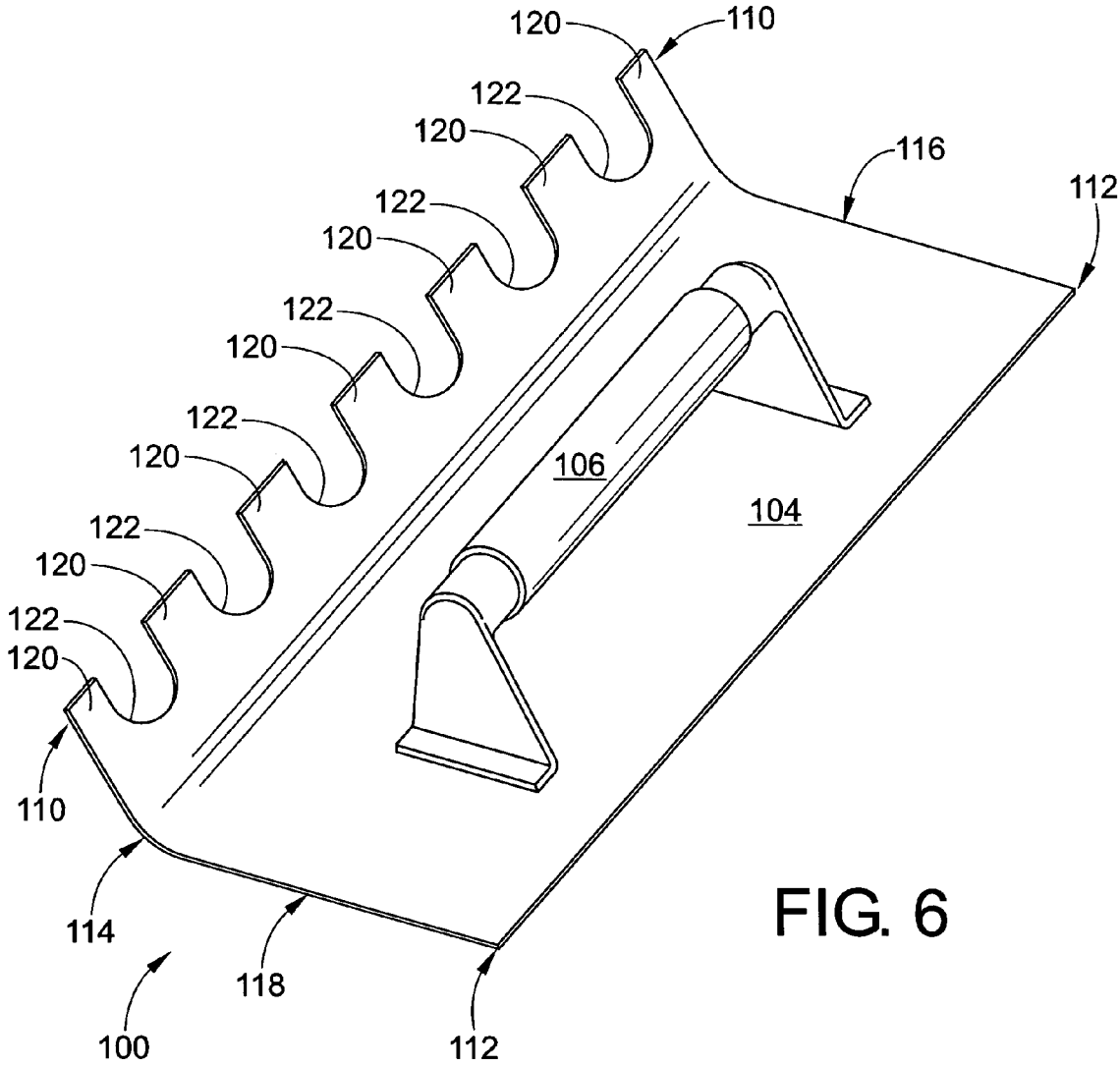
FIG. 6 is a perspective view of a hand tool formed in accordance with the present application.
Figure 6A:
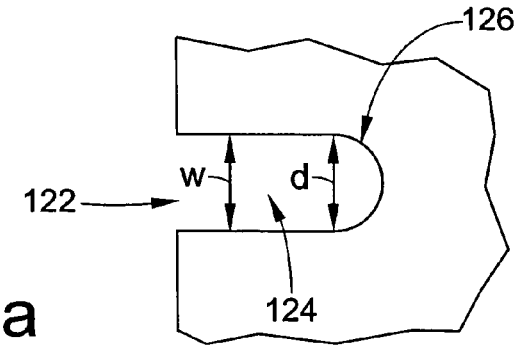
FIG. 6*a* is an enlarged view of portion A from FIG. 6.

With continued reference to FIG. 3 but with additional reference to FIGS. 4-6, the subject hand tool 100 includes a flat substantially inflexible rectangular plate 104 and a handle 106. A first edge 110 of the longer edges of the rectangular plate 104 is upwardly curved as shown in FIGS. 5 and 6. Preferably, the second edge 112 of the longer edges of the rectangular plate 104 is substantially planar together with the plate 104. However, the second edge could be bent upwardly as well, likewise the shorter edges 116, 118. A plurality of spaced apart teeth 120 are defined along the first edge 110 of the plate 104. The teeth 120 are formed between notches 122 provided in the plate at desired spaced apart locations. Preferably, as illustrated, the plurality of spaced apart teeth 120 are formed substantially along the entire length of the first edge 110 of the plate 104. With specific reference to FIG. 6*a*, each of the notches 122 includes an elongate first section 124 having a substantially uniform predefined width w. Each of the notches 122 terminate at a rounded bight 126 having a diameter d substantially conforming to the uniform predefined width w of the elongate first section 124. It is to be appreciated that other shapes and sizes of notches can be provided as desired.

The subject exterior insulation and finish system 30 is installed onto the substrate 32 of the associated building using a hand tool 100, preferably the trowel 102 described above, by dragging the trowel across an adhesive and sealing layer 34 applied onto the sheathing layer 32. The trowel both "plows" through and "floats" on a thick layer 130 of adhesive and sealing material as shown in FIGS. 4 and 5. The upwardly curved portion 114 of the rectangular plate 104 "floats" the plate 104 along the material 130 as the trowel is dragged therealong in the direction D leaving behind a first portion 132 of adhesive and sealing layer 34 having a substantially uniform thickness to completely cover the associated substrate layer 32. Correspondingly, the notches 122 provided along the first edge 110 permit the formation of a series of ridges 60 to be formed as the tool is used thus creating a second portion 134 of adhesive and sealing layer 34 formed on the associated sheathing layer 32. In that way, at least one via 64 is created by the valleys 62 defined between the ridges 60 formed by the hand tool 100.

Figure 7:
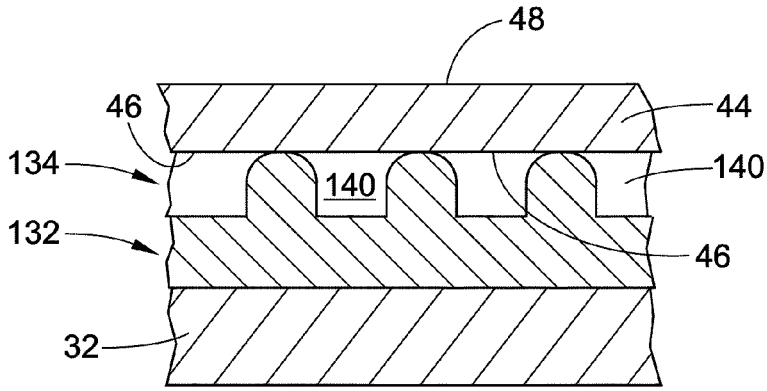
FIG. 7 is a cross-sectional view taken along line 7-7 of FIG. 2; and, FIG. 8 is a schematic representation of various layers forming a drainage type exterior insulation and finish system using a plurality of insulation boards in accordance with the present application.

More particularly, with reference next to FIG. 7, a plurality of channels 140 are formed at the interface between the flat front face 46 of the insulation board 44 and the first portion 132 of the adhesive and sealing layer 34. The channels 140 are adapted to conduct fluid therethrough. It is also important to point out, however, that the first portion 132 of adhesive and sealing layer 34 has a substantially uniform thickness to completely cover the associated substrate layer 32. This provides a safe and secure secondary water barrier coating. As described above, however, additional primary coatings can be formed onto the flat outer face 48 of the insulation board such as by adding a base coat 50, mesh layer 52 and one or more additional base coats 54, 56 (FIG. 2).

Figure 8:
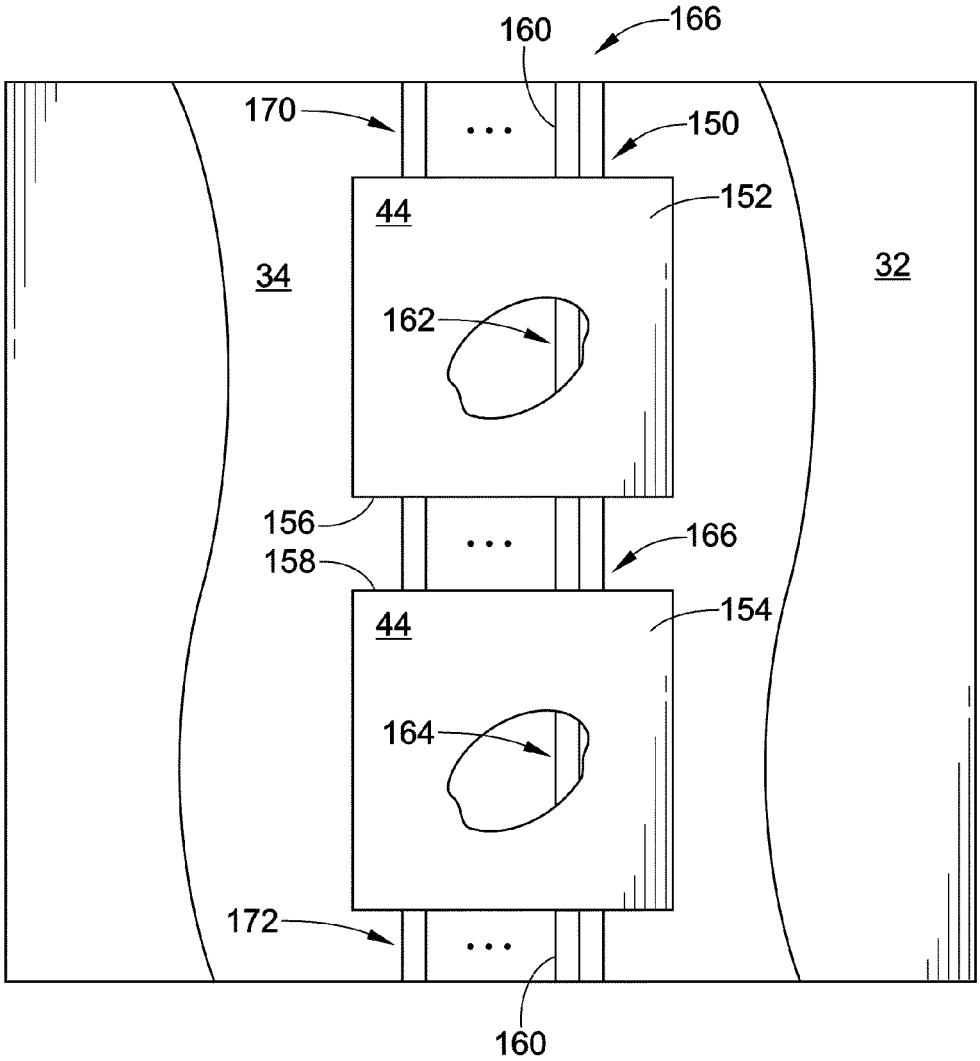

FIG. 8 illustrates another advantage of the subject EIFS system 30 applied to an associated wall assembly 32. A plurality of individual channels 150 are formed between an associated sheathing layer 32 and a plurality of insulation boards 44 including an upper or first insulation board 152 and a lower or second insulation board 154. As shown there, a single adhesive and sealing layer 34 secures the first and second insulation boards 152, 154 to the associated sheathing layer 32. A first edge 156 of the first insulation board 152 is disposed proximate the first edge 158 of the second insulation board 154. At least one via 160 is formed in the adhesive and sealing layer 34 using a hand tool 100, preferably of the type described above. The at least one via 160 extends from a first location 162 between the sheathing substrate 32 and the first insulation board 152, to a second location 164 located between the sheathing substrate 32 and the second insulation board 154. Preferably, a plurality of channels 166 are formed for conducting fluids from a first location 170 above the insulation boards 152, 154 to a second location 172 located beneath the insulation boards 152, 154. In that way, fluid conduction away from the area between the insulation boards and the sheathing substrate is provided.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An insulation and finish system for use with associated insulation and substrate layers of a building, said system comprising:

a primary water resistive barrier on a first surface of said associated insulation layer; and a secondary water resistive barrier on a second surface of said associated insulation layer, said secondary water resistant barrier including a single adhesive and sealing layer adhesively securing said second surface of said associated insulation layer to said associated substrate layer, said single adhesive and sealing layer defining between said second surface of said associated insulation layer and said associated substrate layer a plurality of channels adapted to conduct fluid therethrough while preventing fluid in said channels from contacting said associated substrate layer, said single adhesive and sealing layer being fabricated by covering a portion of said associated substrate layer with adhesive and sealing material, forming a plurality of vias in said adhesive and sealing material, said vias not extending entirely through the thickness of said adhesive and sealing material to maintain a coating of said adhesive and sealing material between said vias and said associated substrate layer, and said second surface of said associated insulation layer being placed in contact with and adhered to said single adhesive and sealing layer, said channels being defined by said vies and said second surface of said associated insulation layer.

2. The system according to claim 1, wherein said associated insulation layer is an insulation board, and said primary water resistive barrier comprises:

a base coat on said insulation board;

a mesh layer in said base coat; and a finish layer on said base coat.

3. The system according to claim 2, wherein:
said associated substrate layer has a flat front face; and
said single adhesive and sealing layer completely covers a portion of said flat front face of said associated substrate layer adjacent said insulation board.

4. The system according to claim 3, wherein:
said insulation board has opposite flat front and rear faces, said flat rear face of said insulation board being oriented toward said flat front face of said associated substrate layer; and
each of said channels is defined in part by said flat rear face of said insulation board.

5. The system according to claim 1, wherein said second surface of said associated insulation layer is substantially flat.

6. The system according to claim 1, wherein said single adhesive and sealing layer is disposed between said associated insulation layer and said associated substrate layer and includes a first portion having a substantially uniform thickness to completely cover said associated substrate layer and a second portion having a non-uniform thickness to provide said channels.

7. The system according to claim 1, wherein said primary and secondary water resistive barriers form a drainage type exterior insulation and finish system.

8. The system according to claim 1, wherein:
said associated insulation layer comprises:
a first insulation board having opposite front and back surfaces and a first edge, and
a second insulation board having opposite front and back surfaces and a first edge;
said single adhesive and sealing layer secures said first and second insulation boards to said associated substrate layer with said first edge of the first insulation board proximate said first edge of the second insulation board, at least one of said vias extending from a first location between said associated substrate layer and said first insulation board to a second location between said associated substrate layer and said second insulation board; and
said primary water resistive barrier comprises:
a base coat on said first and second insulation boards,
a mesh layer in said base coat, and
a finish layer on said base coat.

9. The system according to claim 8, wherein said at least one via extends uninterrupted from said first location to said second location.

10. The system according to claim 1, wherein:
said associated insulation layer comprises first and second insulation panels, each having a first surface and a second surface; and
said single adhesive and sealing layer adhesively secures said second surfaces of said first and second insulation panels to said associated substrate layer with at least one edge of each of said first and second insulation panels substantially in abutment, at least one of said vias extending from said first insulation panel to said second insulation panel.

11. The system according to claim 10, wherein said second surfaces of said first and second insulation panels are substantially flat.

12. The system according to claim 1, wherein said vias are formed by troweling said adhesive and sealing material covering said associated substrate layer with a hand tool comprising a substantially rigid plate with an upwardly curved edge having a plurality of spaced-apart teeth, said teeth of said hand tool forming said vias in said adhesive and sealing material, said vias being separated by ridges, and said second surface of said associated insulating layer contacting and adhering to said ridges to define said channels in association with said vias.

13. The system according to claim 1, wherein said vias are formed by troweling said adhesive and sealing material covering said associated substrate layer with a hand tool comprising:
a flat substantially inflexible rectangular plate having two parallel longer edges and two parallel shorter edges, at least a first one of said longer edges being upwardly curved and including a plurality of spaced-apart teeth, said teeth of said hand tool forming said vias in said adhesive and sealing material, said vias being separated by ridges, and said second surface of said associated insulating layer contacting and adhering to said ridges to define said channels in association with said vias; and
a handle connected with said rectangular plate.

14. The system according to claim 13, wherein the other of said longer edges of said rectangular plate is flat.

15. The system according to claim 13, wherein said plurality of spaced apart teeth are formed substantially along the entire length of said first one of said longer edges of said rectangular plate.

16. The system according to claim 15, wherein said plurality of spaced apart teeth are defined between a plurality of notches formed in said first one of said longer edges of said rectangular plate.

17. The system according to claim 16, wherein each of said plurality of notches includes an elongate first section having a substantially uniform predefined width terminating at a rounded bight having a diameter substantially conforming to said uniform predefined width.

18. The system according to claim 17, wherein each of said plurality of notches has substantially the same shape.

19. An insulation and finish system for use with associated insulation and substrate layers of a building, said system comprising:
a primary water resistive barrier on a first surface of said associated insulation layer; and
a secondary water resistive barrier on a second surface of said associated insulation layer, said secondary water resistant barrier including a single adhesive and sealing layer adhesively securing said second surface of said associated insulation layer to said associated substrate layer, said single adhesive and sealing layer defining between said second surface of said associated insulation layer and said associated substrate layer a plurality of channels adapted to conduct fluid therethrough while preventing fluid in said channels from contacting said associated substrate layer, said single adhesive and sealing layer being fabricated by covering a portion of said associated substrate layer with adhesive and sealing material, forming a plurality of vias in said adhesive and sealing material, said vias not extending entirely through the thickness of said adhesive and sealing material to maintain a coating of said adhesive and sealing material between said vias and said associated substrate layer, and said second surface of said associated insulation layer being placed in contact with and adhered to said single adhesive and sealing layer, said channels being defined by said vias and said second surface of said associated insulation layer;

wherein said vias are formed by troweling said adhesive and sealing material covering said associated substrate layer with a hand tool comprising:

a substantially inflexible rectangular plate having opposed surfaces and including a substantially flat first portion and a curved second portion, said curved second portion being disposed along a first long edge of said rectangular plate, said first long edge having a plurality of spaced-apart teeth, said teeth forming said vias in said adhesive and sealing material, said vias being separated by ridges, and said second surface of said associated insulating layer contacting and adhering to said ridges to define said channels in association with said vias; and a handle connected to one of said opposed surfaces of said rectangular plate, said second portion of said plate being curved toward said handle.

* * * * *